US011370008B2

(12) United States Patent
Dollhäubl et al.

(10) Patent No.: US 11,370,008 B2
(45) Date of Patent: Jun. 28, 2022

(54) STRIPPING DEVICE FOR A ROLL STAND

(71) Applicant: Primetals Technologies Austria GmbH, Linz (AT)

(72) Inventors: Paul Felix Dollhäubl, Zwettl an der Rodl (AT); Gregor Gerstorfer, Linz (AT); Erich Opitz, Mönchhof (AT)

(73) Assignee: PRIMETALS TECHNOLOGIES AUSTRIA GMBH

( * ) Notice: Subject to any disclaimer, the term of this patent is extended or adjusted under 35 U.S.C. 154(b) by 153 days.

(21) Appl. No.: 16/320,542

(22) PCT Filed: Jul. 13, 2017

(86) PCT No.: PCT/EP2017/067666

§ 371 (c)(1),
(2) Date: Jan. 25, 2019

(87) PCT Pub. No.: WO2018/033305

PCT Pub. Date: Feb. 22, 2018

(65) Prior Publication Data

US 2019/0240709 A1 Aug. 8, 2019

(30) Foreign Application Priority Data

Aug. 18, 2016 (EP) ..... 16184722

(51) Int. Cl.
*B21B 27/10* (2006.01)

(52) U.S. Cl.
CPC ..... *B21B 27/10* (2013.01); *B21B 2027/103* (2013.01)

(58) Field of Classification Search
CPC ..... B21B 27/10; B21B 2027/13; B21B 28/00; B21B 28/02; B21B 45/0275;
(Continued)

(56) References Cited

U.S. PATENT DOCUMENTS 3,845,539 A * 11/1974 Yamagishi ..... B21B 27/10 118/200
4,160,005 A 7/1979 Renkowsky ..... 264/137
(Continued)

FOREIGN PATENT DOCUMENTS

CN 2400196 Y 10/2000
CN 201172061 Y 12/2008
(Continued)

OTHER PUBLICATIONS

Machine Translation of JP-2016107303-A (Year: 2016).*
(Continued)

*Primary Examiner* — Teresa M Ekiert
*Assistant Examiner* — Teresa A Guthrie
(74) *Attorney, Agent, or Firm* — Ostrolenk Faber LLP

(57) ABSTRACT

A stripping device (7) for a roll stand (1) includes a stripper carrier (15) and a stripper (17) arranged on the stripper carrier (15). The stripper (17) has a main body (19) produced from a fiber-plastic composite. The main body has a main body bottom side (23), which contacts the stripper carrier (15). A felt layer (21) is arranged on a main body top side (25) of the main body (19) which is opposite the main body bottom side (23).

14 Claims, 3 Drawing Sheets

Figure 1:
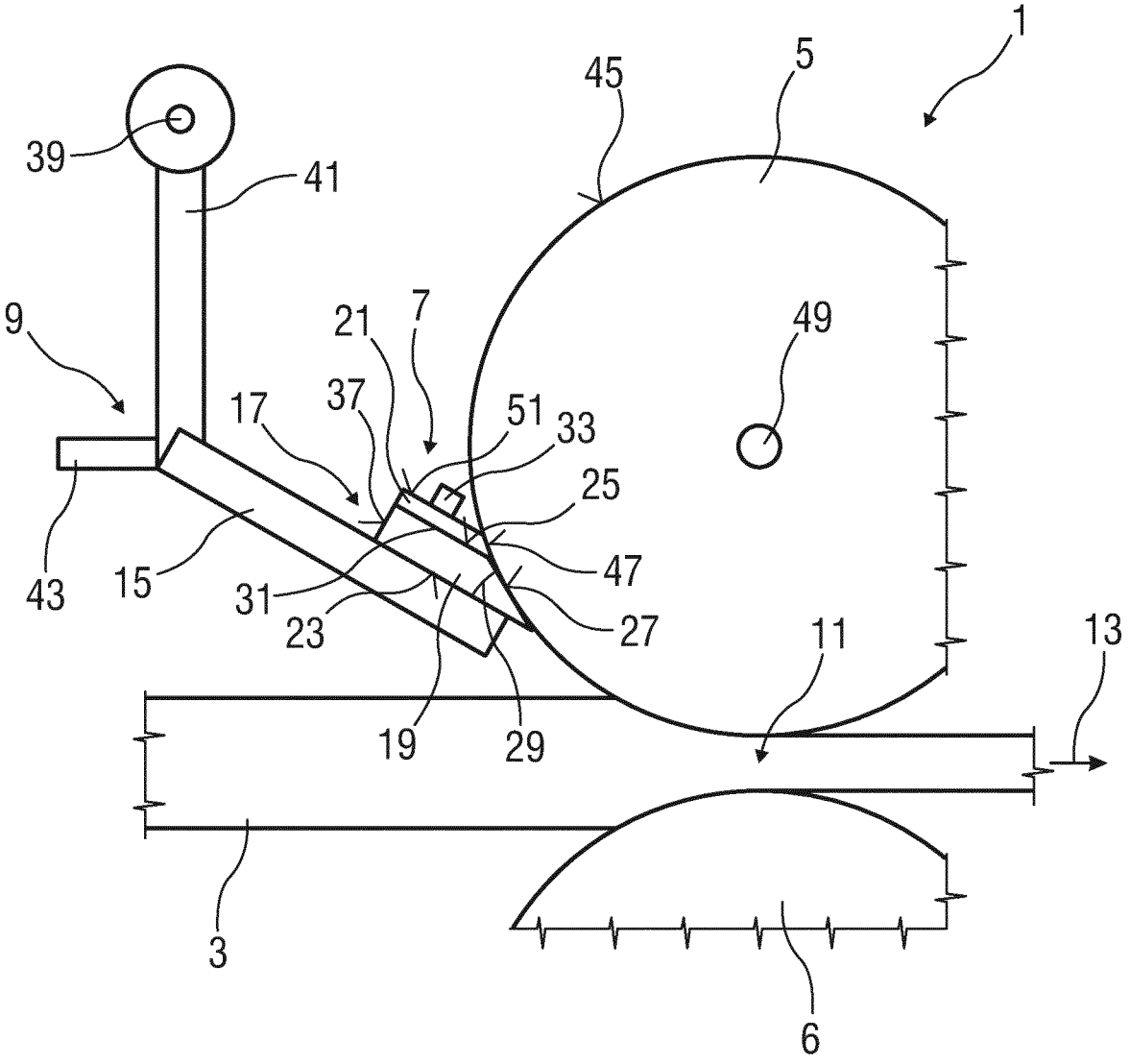

(58) Field of Classification Search
CPC ..... B21B 45/0278; B21B 45/0269; B21B 45/0281; B21B 45/0284; D21G 3/005; B24D 15/02; B24D 15/023
USPC ..... 72/201, 236; 15/256.51, 256.5
See application file for complete search history.

(56) References Cited

U.S. PATENT DOCUMENTS

| | | | | | |
|---|---|---|---|---|---|
| 4,586,212 | A * | 5/1986 | Gasser | D01H 5/62 | 15/256.51 |
| 2010/0077820 | A1* | 4/2010 | Porco | A46B 5/0054 | 72/112 |
| 2014/0090437 | A1* | 4/2014 | Clark | B21B 28/04 | 72/250 |

FOREIGN PATENT DOCUMENTS

| | | | | | |
|---|---|---|---|---|---|
| CN | 204448819 | U | | 7/2015 | |
| CN | 205341502 | U | | 6/2016 | |
| DE | 100 49 032 | A1 | | 5/2002 | |
| EP | 2 079 553 | B1 | | 1/2010 | |
| EP | 2 384 829 | A1 | | 11/2011 | |
| JP | S54-74869 | A | | 6/1979 | |
| JP | S55-177901 | U | | 12/1980 | |
| JP | H05-154517 | A | | 6/1993 | |
| JP | H08-215718 | A | | 8/1996 | |
| JP | 3008286 | B1 | | 2/2000 | |
| JP | 2000-204348 | A | | 7/2000 | |
| JP | 2010-274301 | A | | 12/2010 | |
| JP | 2016-107303 | A | | 6/2016 | |
| JP | 2016107303 | A | * | 6/2016 | |
| RU | 57156 | U1 | | 10/2006 | |
| SU | 77623 | A | | 10/1890 | |
| SU | 1301499 | A1 | | 4/1987 | |
| WO | WO-2009036838 | A1 | * | 3/2009 | B21B 28/00 |

OTHER PUBLICATIONS

Translation of JP-2016107303-A (Year: 2016).*
Chinese Office Action, dated Oct. 12, 2019, issued in corresponding Chinese Patent Application No. 201780050550.6. Total 5 pages.
Japanese Office Action, dated Jan. 27, 2020, issued in corresponding Japanese Patent Application No. 2019-508258. English translation. Total pp. 9.
International Search Report dated Aug. 8, 2017 in corresponding PCT International Application No. PCT/EP2017/067666.
European Search Report dated Oct. 28, 2016 in corresponding European Patent Application No. PCT/EP2017/067666.
Russian Federation Decision to Grant, dated Nov. 14, 2019, issued in corresponding Russian Federation Patent Application No. 2019104282/02(008119). Total pp. 9 pages.

* cited by examiner

STRIPPING DEVICE FOR A ROLL STAND

CROSS-REFERENCE TO RELATED APPLICATIONS

The present application is a 35 U.S.C. §§ 371 national phase conversion of PCT/EP2017/067666, filed Jul. 13, 2017, which claims priority of European Patent Application No. 16184722.3, filed Aug. 18, 2016, the contents of which are incorporated by reference herein. The PCT International Application was published in the German language.

FIELD OF THE INVENTION

The invention relates to a stripping device for a roll stand.

BACKGROUND OF THE INVENTION

Roll stands for rolling of rolling stock have rolls which are cooled using a cooling fluid, generally cooling water. To prevent too much cooling fluid getting onto the rolling stock and/or into a roll nip through which the rolling stock is guided between two rolls, stripping devices are used, which strip cooling fluid off the roll surfaces of the rolls.

EP 2 079 553 B1 discloses a roll stand having backup and/or working rolls, at least one rest bar arranged between inserts of one of the rolls, an entry/exit guide, arranged adjacent to the rest bar, for a medium, e.g. cooling water or the like, and a sealing strip, arranged between the rest bar and the entry/exit guide, to prevent the medium from dripping, particularly onto the rolling stock.

CN 204448819 U discloses a stripping plate for a hot roll stand. The stripping plate is constructed from a felt layer, a backing plate made of iron and a base plate, wherein these components of the stripping plate are connected by screws.

EP 2 384 829 A1 discloses a method for removing coolant and/or lubricant from rolls of a roll stand, wherein at least one stripping device having a stripping edge rests with a contact pressure against a roll surface of a working roll or a backup roll supporting the working roll in the roll stand on an entry side and/or an exit side of the roll stand.

DE 100 49 032 A1 discloses a roll stand having backup and/or working rolls, a rest bar arranged between the working roll inserts and associated with the upper roll, and on the lower circumference of the roll, and a water stripper, which is secured on the rest bar and can be externally set against the roll surface by adjusting means.

JP 2016 107303 A discloses a stripper for stripping cooling water from a roll in a steel rolling mill. The stripper has a polishing plate for polishing the roll surface. Polishing grains are uniformly distributed in a nonwoven material in the polishing plate. A water-wiping material for wiping away the cooling water is laminated onto a surface of the polishing plate.

SUMMARY OF THE INVENTION

It is the main object of the invention to provide an improved stripping device for a roll stand.

A stripping device according to the invention for a roll stand comprises a stripper carrier with a stripper arranged on the stripper carrier. The stripper comprises a main body manufactured from a fiber-reinforced plastic and having a main body bottom side, which rests against the stripper carrier, and a felt layer, which is arranged on a main body top side of the main body which is opposite the main body bottom side.

Because the main body is manufactured from a fiber-reinforced plastic, the stripping device makes possible a significant reduction in the weight of the stripping device relative to stripping devices with metallic components and hence allows easier movement and exchange of the stripping device.

The construction of the stripper from a main body and a felt layer furthermore makes it possible to use both the main body and the felt layer as seals for stripping and removing cooling fluid applied to a roll surface of the roll to cool a roll of the roll stand from the roll surface. This makes it possible to prevent too much cooling fluid from getting onto the rolling stock and/or into a roll nip between two rolls of the roll stand from the roll surface and, in particular, reduces the effect of lubricant applied there for the lubrication of the contact between the roll and the rolling stock, e.g. by washing away or diluting the lubricant.

The suction effect of the felt layer enhances the sealing effect thereof and furthermore advantageously cools the stripper by absorbing cooling fluid in the felt layer. By virtue of its flexibility and elasticity, the felt layer furthermore compensates for fluctuations in the radius of the roll along the width and circumference thereof as well as manufacturing tolerances in the main body front side, which reduce the sealing effect of the main body front side.

One embodiment of the invention envisages that the main body has a main body front side which is angled from the main body bottom side toward the main body top side at an angle of incidence. This embodiment of the invention advantageously makes it possible to use the main body front side to make contact with the roll over as large a contact area as possible.

Another embodiment of the invention envisages that the felt layer is adhesively bonded to the main body top side, e.g. by means of a two-component epoxy resin adhesive. This embodiment of the invention advantageously prevents displacement of the felt layer relative to the main body.

Another embodiment of the invention envisages that a stripper rear side of the stripper situated opposite the main body front side has stripper recesses, which each extend from the main body bottom side to a stripper top side of the stripper situated opposite the main body bottom side, and that the stripper carrier is connected to the stripper by connecting elements, which are each guided by a stripper recess and are connected to the stripper carrier. The connecting elements are screws or pins, for example. According to this embodiment of the invention, there is advantageously no need to remove the connecting elements to separate the stripper from the stripper carrier. That only requires loosening the connections of the connecting elements to the stripper carrier to enable the stripper to be pulled off the stripper carrier. This advantageously facilitates exchange of the stripper, e.g. in the case of a defect or wear of the stripper.

Another embodiment of the invention envisages that the fiber-reinforced plastic is a composite of glass filament fabric and epoxy resin. A composite of glass filament fabric and epoxy resin advantageously makes possible a high heat resistance, high dimensional stability and a high sealing effect of the main body.

Another embodiment of the invention envisages that the felt layer has a bulk density of at least 320 $kg/m^3$, and preferably more than 520 $kg/m^3$. As a result, the felt layer advantageously has a sufficient felt hardness to achieve increased resistance to mechanical wear due to the contact with the rotating roll of the roll stand.

A roll stand according to the invention comprises a roll, a stripping device according to the invention and a contact pressure device for pressing a main body front side of the main body against a roll surface of the roll. The advantages of a roll stand of this kind result from the above mentioned advantages of a stripping device according to the invention.

One embodiment of the invention envisages that the felt layer has a felt layer front side, which faces the roll and which rests against the roll surface when the main body front side is pressed against the roll surface. Since the felt layer front side rests against the roll surface immediately after the pressing on of the stripper, the felt layer enhances the sealing effect of the stripper, especially at the beginning of contact pressure, when the sealing effect of the main body front side is not yet sufficient. Therefore, there is no need for a start-up time to achieve a sufficient sealing effect of the stripper. It is thereby advantageously possible to increase the production time with a good lubricating effect of a lubricant for lubricating the contact between the roll and the rolling stock, to keep the cooling fluid away from the rolling stock even during the start of rolling at the beginning or after an interruption of the rolling process.

Further embodiments of the invention envisage that the contact pressure device has a pivotally mounted pivot arm for moving the stripping device up to the roll and/or has a hydraulic or pneumatic drive for pressing the main body front side against the roll surface. These embodiments of the invention advantageously allow monitored and controllable pressing of the stripper against the roll.

The above-described properties, features and advantages of this invention and the manner in which these are achieved will become clearer and more transparent in conjunction with the following description of illustrative embodiments, which are explained in greater detail in conjunction with the drawings. In the drawings:

BRIEF DESCRIPTION OF THE DRAWING FIGURES

Figure 2:
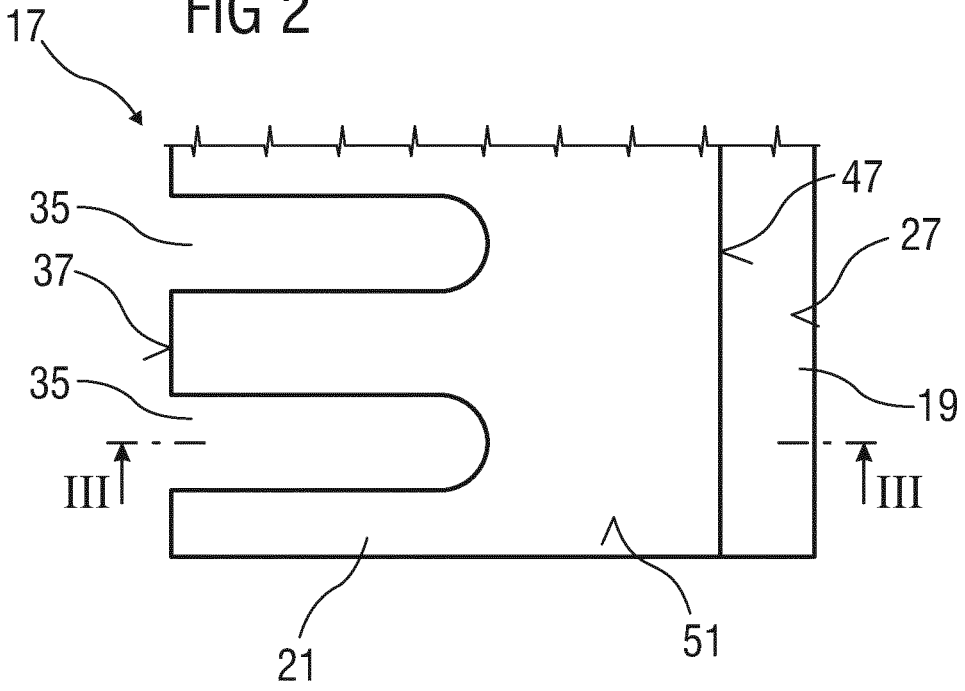
Figure 3:
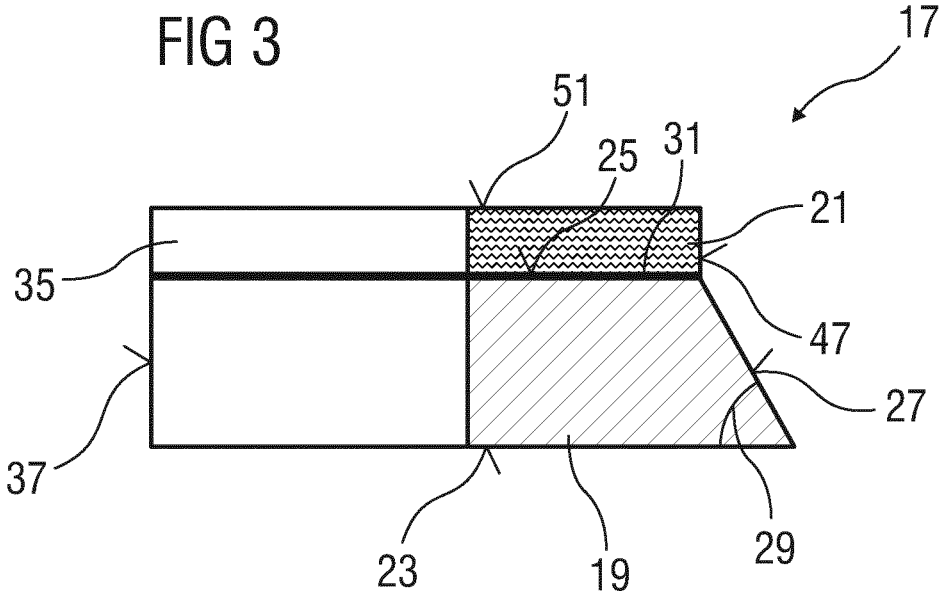
Figure 4:
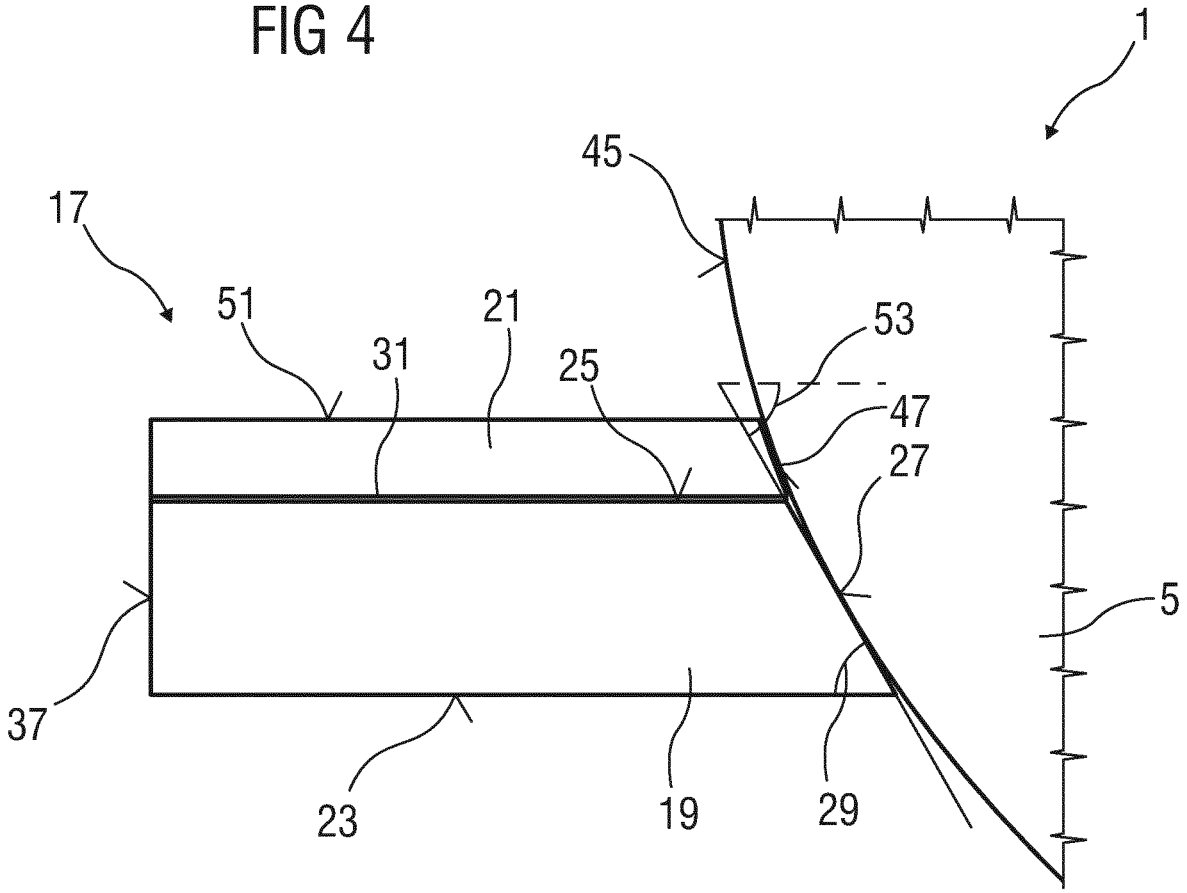

FIG. 1 schematically shows a roll stand having a roll, a first illustrative embodiment of a stripping device and a contact pressure device, FIG. 2 shows a plan view of a stripper of a second illustrative embodiment of a stripping device, FIG. 3 shows a section through the stripper illustrated in FIG. 2, and FIG. 4 shows a side view of the stripper illustrated in FIGS. 2 and 3 and of a roll of a roll stand, against which the stripper rests.

Parts that correspond to each other are provided with the same reference signs in all the figures.

DESCRIPTION OF AN EMBODIMENT

FIG. 1 shows schematically a roll stand 1 for rolling a rolling stock 3. The roll stand 1 comprises two parallel, spaced apart rolls 5, 6, which are in a form of working rolls. For at least one roll 5, there is a stripping device 7 and a contact pressure device 9. The rolls 5, 6 are spaced apart to define a rolling nip 11, through which the rolling stock 3 is passed in a rolling direction 13 in order to form the rolling stock 3, e.g. to reduce its thickness.

The stripping device 7 comprises a stripper carrier 15 and a stripper 17 arranged on the stripper carrier 15. The stripper 17 comprises a main body 19 and a felt layer 21.

The main body 19 is comprised of a fiber-reinforced plastic, which preferably has a heat resistance up to an upper use temperature above at least 80° C., preferably above 120° C., and a high dimensional stability. For example, the fiber-reinforced plastic is a composite of glass filament fabric and epoxy resin. The main body 19 has a main body bottom side 23, which rests against the stripper carrier 15, and a main body top side 25, on which the felt layer 21 is arranged. The main body 19 furthermore has a main body front side 27 which is angled from the main body bottom side 23 toward the main body top side 25 at an acute angle of incidence 29.

The felt layer 21 is adhesively bonded to the main body top side 25 by an adhesive bonding layer 31, which is formed by a two-component epoxy resin adhesive, for example. The felt layer 21 is manufactured from an industrial felt, for example, and preferably has a felt hardness of at least F1, preferably at least H2, according to DIN 61200 and a bulk density of at least 320 kg/m$^3$, preferably of more than 520 kg/m$^3$. The felt layer 21 completely covers the main body top side 25.

The stripper carrier 15 is connected to the stripper 17 by connecting elements 33, which are each guided by a stripper recess 35 (not visible in FIG. 1) in a stripper rear side 37 of the stripper 17 situated opposite the main body front side 27 and are connected to the stripper carrier 15, cf FIGS. 2 and 3. The connecting elements 33 are screws or pins, for example, with screw or pin heads resting against the felt layer 21. As an alternative, the screw or pin heads can also rest against a retention plate arranged on the felt layer 21 or against the main body top side 25, wherein, in the case of the second alternative, the felt layer 21 has apertures for the screw or pin heads.

The contact pressure device 9 has a pivot arm 41, pivotably mounted about a pivot 39, for moving the stripping device 7 up to the roll 5, and has a hydraulic or pneumatic drive 43 for pressing the stripper 17 against the roll 5. The pivot arm 41 is rigidly connected to the stripper carrier 15 and can be pivoted by the drive 43.

When the stripper 17 is pressed against the roll 5, the main body front side 27 rests against a roll surface 45 of the roll 5. Furthermore, a felt layer front side 47 of the felt layer 21 which faces the roll 5 rests against the roll surface 45 when the stripper 17 is pressed against the roll 5 and is compressed as it is pressed on.

The stripper 17 extends over at least part of the width of the roll 5, parallel to a roll rotation axis 49 of the roll 5, i.e. perpendicularly to the plane of the drawing in FIG. 1. The stripper 17 is pressed on by the drive 43, e.g. with a force of at least one Newton per millimeter of stripper length, wherein the stripper length is an extent of the stripper 17 parallel to the roll rotation axis 49.

As a result of the main body front side 27 being pressed against the roll surface 45, the main body front side 27 acts as a seal for stripping and removing from the roll surface 45 cooling fluid which is applied to the roll surface 45 to cool the roll 5. This prevents too much cooling fluid from getting onto the rolling stock 3 and/or into the roll nip 11 from the roll surface 45 and, in particular, reduces the effect of lubricant applied there for the lubrication of the contact between the roll 5 and the rolling stock 3, e.g. by washing away and diluting the lubricant.

Here, the felt layer front side 47 resting against the roll surface 45 acts as an additional seal for stripping and removing cooling fluid from the roll surface 45. Since the felt layer front side 47 rests against the roll surface 45 immediately after the pressing on of the stripper 17, the felt layer 21 enhances the sealing effect of the stripper 17, especially at the beginning of contact pressure, when the sealing effect of the main body front side 27 is not yet sufficient, and therefore there is no need for a start-up time to achieve a sufficient sealing effect of the stripper 17.

The suction effect of the felt layer 21 enhances the sealing effect thereof and furthermore advantageously cools the stripper 17 by absorbing cooling fluid in the felt layer 21.

By virtue of its flexibility and elasticity, the felt layer 21 furthermore compensates for fluctuations in the radius of the roll 5 along the width and circumference thereof as well as manufacturing tolerances in the main body front side 27, which reduce the sealing effect of the main body front side 27.

FIGS. 2 and 3 show a stripper 17 of a second illustrative embodiment of a stripping device 7. Here, FIG. 2 shows a plan view of an end portion of the stripper 17, and FIG. 3 shows a section through the stripper 17 in a section plane III.

The stripper 17 illustrated in FIGS. 2 and 3 differs from the stripper 17 illustrated in FIG. 1 only in that the angle of incidence 29 between the main body bottom side 23 and the main body front side 27 of the main body 19 is greater than in the case of the stripper 17 illustrated in FIG. 1. Apart from this, the stripper 17 illustrated in FIGS. 2 and 3 and the other components of the stripping device 7 having the stripper 17 which are not illustrated in FIGS. 2 and 3 are the same as the corresponding components of the stripping device 7 illustrated in FIG. 1.

The stripper rear side 37 of the stripper 17 has stripper recesses 35, which each extend from the main body bottom side to a stripper top side 51 of the stripper 17 situated opposite the main body bottom side 23, the top side being a surface of the felt layer 21 which faces away from the main body 19, and are arranged adjacent to one another over the stripper length of the stripper 17. Each stripper recess 35 extends into the stripper 17 from the stripper rear side 37 approximately as far as half way between the stripper rear side 37 and the main body front side 27. A connecting element 33 not shown in FIGS. 2 and 3 (cf FIG. 1) is passed through an end of each stripper recess 35 facing the main body front side 27 to the stripper carrier 15 in order to connect the stripper carrier 15 to the stripper 17. As a result, there is advantageously no need to remove the connecting elements 33 to separate the stripper 17 from the stripper carrier 15, all that is required being to loosen the connections of the connecting elements 33 to the stripper carrier 15 to enable the stripper 17 to be pulled off the stripper carrier 15.

FIG. 4 shows a side view of the stripper 17 illustrated in FIGS. 2 and 3 and of a roll 5 of a roll stand 1, against which the stripper 17 is pressed. The angle of incidence 29 is preferably selected as an angle of engagement 53 of the roll 5 with the stripper 17 at the mean roll diameter in order to produce as large as possible a contact area between the main body front side 27 and the roll surface 45.

Although the invention has been illustrated and described more specifically in detail by means of preferred illustrative embodiments, the invention is not restricted by the examples disclosed, and other variations can be derived therefrom by a person skilled in the art without exceeding the scope of protection of the invention.

The invention claimed is:

1. A stripping device for a roll stand, the stripping device comprising:

a stripper carrier;

a stripper arranged on the stripper carrier, the stripper comprising:

a main body having a main body bottom side, and the main body bottom side rests against the stripper carrier; and the main body having a main body top side opposite the main body bottom side;

the main body having a main body front side that extends from the main body bottom side to the main body top side, meets the main body bottom side at a bottom junction to form an acute angle of incidence with the main body bottom side, meets the main body top side at a top junction, and extends from the bottom junction to the top junction at the acute angle of incidence;

a felt layer that is arranged on the main body top side and terminates at the top junction of the main body front side and the main body top side, the felt layer having a felt layer front side that extends from the top junction of the main body front side and the main body top side at another angle of incidence larger than the acute angle of incidence whereby the felt layer front side and the main body front side form an angle less than 180° to permit the felt layer front side to rest against a roll surface of a roll in the roll stand when the main body front side is pressed against the roll surface;

the main body is comprised of a fiber-reinforced plastic; and the stripper having a rear side situated opposite the main body front side, the stripper rear side has stripper recesses, each stripper recess extends from the main body bottom side to a stripper top side of the stripper situated opposite the main body bottom side, and connecting elements connecting the stripper carrier to the stripper, the connecting elements are each guided by a respective stripper recess of the stripper recesses and are connected to the stripper carrier.

2. The stripping device as claimed in claim 1, further comprising the felt layer is adhesively bonded to the main body top side.

3. The stripping device as claimed in claim 2, further comprising a two-component epoxy resin adhesive adhesively bonding the felt layer to the main body top side.

4. The stripping device as claimed in claim 1, wherein the connecting elements are screws.

5. The stripping device as claimed in claim 1, wherein the connecting elements are pins.

6. The stripping device as claimed in claim 1, wherein the fiber-reinforced plastic is a composite comprised of glass filament fabric and epoxy resin.

7. The stripping device as claimed in claim 1, wherein the felt layer has a bulk density of at least 320 kg/m$^3$.

8. A roll stand comprising:

a roll having a roll surface; and a stripping device for a roll stand, the stripping device comprising:

a stripper carrier;

a stripper arranged on the stripper carrier, the stripper comprising:

a main body having a main body bottom side, and the main body bottom side rests against the stripper carrier; and the main body having a main body top side opposite the main body bottom side;

the main body having a main body front side that extends from the main body bottom side to the main body top side, meets the main body bottom side at a bottom junction to form an acute angle of incidence with the main body bottom side, meets the main body top side at a top junction, and extends from the bottom junction to the top junction at the acute angle of incidence;

a felt layer that is arranged on the main body top side and terminates at the top junction of the main body front side and the main body top side;

the main body is comprised of a fiber-reinforced plastic; and the stripper having a rear side situated opposite the main body front side, the stripper rear side has stripper recesses, each stripper recess extends from the main body bottom side to a stripper top side of the stripper situated opposite the main body bottom side, and connecting elements connecting the stripper carrier to the stripper, the connecting elements are each guided by a respective stripper recess of the stripper recesses and are connected to the stripper carrier, wherein the felt layer has a felt layer front side that extends from the top junction of the main body front side and the main body top side at another angle of incidence larger than the acute angle of incidence whereby the felt layer front side and the main body front side form an angle less than 180° to permit the felt layer front side to rest against a roll surface of a roll in the roll stand when the main body front side is pressed against the roll surface.

9. The roll stand as claimed in claim 8, further comprising a pivotally mounted pivot arm configured and operable for moving the stripping device to the roll.

10. The roll stand as claimed in claim 8, further comprising a hydraulic or pneumatic drive configured for pressing the main body front side against the roll surface.

11. The roll stand as claimed in claim 8, further comprising a contact pressure device configured and operable to press the main body front side against the roll surface.

12. The stripping device as claimed in claim 1, wherein a step is defined in the main body top side, and the felt layer is received in the step.

13. The stripping device as claimed in claim 1, wherein the stripper top side includes a top surface of the felt layer and a portion of the main body top side that extends from the rear side to the felt layer.

14. The roll stand as claimed in claim 8, wherein the main body front side has a leading edge, and the leading edge is oriented in the direction of rotation of the roll.

* * * * *